US005365845A

United States Patent [19]

Becker

[11] Patent Number: 5,365,845

[45] Date of Patent: Nov. 22, 1994

[54] METHOD AND DEVICE FOR STARTING AND STOPPING A SHEET-TURNING OPERATION AND FOR FORMAT ADJUSTING

[75] Inventor: Willi Becker, Bammental, Germany

[73] Assignee: Heidelberger Druckmaschinen AG, Heidelberg, Germany

[21] Appl. No.: 91,966

[22] Filed: Jul. 15, 1993

[30] Foreign Application Priority Data

Jul. 15, 1992 [DE] Germany ..... 4223190

[51] Int. Cl.[5] ..... B41F 5/02; B41F 21/10; B41F 1/20

[52] U.S. Cl. ..... 101/230; 101/486

[58] Field of Search ..... 101/229, 230, 231, 183, 101/232, 485, 486, 211, 136, 141, 409–411; 271/DIG. 902, 184, 225, 82

[56] References Cited

U.S. PATENT DOCUMENTS 4,014,261 3/1977 Becker .
4,122,773 10/1978 Wirz .
4,357,870 11/1982 Rudolph et al. .
4,628,817 12/1986 Trinks et al. .
5,031,531 7/1991 Becker .
5,033,379 7/1991 Becker ..... 101/230
5,076,164 12/1991 Becker .
5,085,143 2/1992 Becker .
5,105,737 4/1992 Becker .
5,265,528 11/1993 Mathes .

FOREIGN PATENT DOCUMENTS 2460503 7/1976 Germany .
2419747 11/1976 Germany .
151134 10/1981 Germany .
3136349 8/1982 Germany .
8319431 2/1984 Germany .
232881 2/1986 Germany .
237426 7/1986 Germany .
3814831 10/1989 Germany .
3836310 4/1990 Germany .
3900818 5/1990 Germany .
3911609 10/1990 Germany .
3911630 10/1990 Germany .
3920821 1/1991 Germany .
2225556 6/1990 United Kingdom .

*Primary Examiner*—J. Reed Fisher
*Attorney, Agent, or Firm*—Herbert L. Lerner; Laurence A. Greenberg

[57] ABSTRACT

A method and a device for automatically starting and stopping a sheet-turning operation during the transport of sheets through a printing press for facilitating changeover of transport drums between two printing units from single side or recto-printing mode to a perfector or recto-and-verso printing mode.

6 Claims, 4 Drawing Sheets

METHOD AND DEVICE FOR STARTING AND STOPPING A SHEET-TURNING OPERATION AND FOR FORMAT ADJUSTING

The invention relates to a method and a device for automatically starting and stopping a sheet-turning operation during the transport of sheets through a printing press, particularly the changeover of the transport drums or cylinders between two printing units from single side or recto-printing mode to first form and perfector or recto-and-verso printing mode, and back again.

For printing on both sides of sheets in one pass, printing presses have become known heretofore, wherein a sheet-turning device is provided between two printing units, the sheet-turning device being turned off during single-side or rector-printing mode and being turned on during first-form and perfector or recto-and-verso printing mode. (Published German Patent Documents 24 19 747 C3, 39 11 609 A1, 39 20 821 A1, 39 11 630 A1, 39 00 818 C1, 38 14 831 C1, 24 60 503 A1).

A printing press is described, for example, in published German Patent Document 24 60 503 C3, having a changeover and adjusting or setting device wherein, in single-side or recto-printing mode, a sheet oncoming from a preceding printing unit is accepted or received at the leading edge thereof by the grippers of a transfer drum and is passed on by the leading edge thereof to a first of two gripper systems of a storage drum having double the diameter of conventional printing-unit cylinders. The storage drum transfers the sheet, again by the leading edge thereof, to the grippers of a third drum which acts as the turning drum in first-for and perfector or recto-and-verso printing mode. All of the transport drums operate. In synchronism, an operation which is realized by means of a drive with a closed gear train or by means of a drive with a plurality of mechanically decoupled motors having a regulated rotational speed. The gripper systems of the individual transport drums are cam-controlled, different gripper-opening cams being used in single-side or recto-printing mode and in first-form and perfector or recto-and-verso printing mode.

In contrast with single-side or recto-printing mode, the leading edge of the sheet, in first-form and perfector or recto-and-verso printing mode, is guided past the turning drum by the gripper system of the storage drum. The sheet is then gripped at the trailing edge thereof by the gripper system of the third drum, the gripper system of the third drum executing a 180-degree swiveling movement, and the gripper system of the storage drum releasing the leading edge of the sheet. The turned sheet is then passed on by the trailing edge thereof to a following printing unit for printing on the second side of the sheet. As the sheet is being transported on the storage drum, the sheet may be held and smoothly or tightly drawn by means of eccentric rotary suckers at the end of the sheet on the storage drum. Only at the instant of transfer is suction air at the rotary sucker shut off in an angle-controlled manner.

In general, the starting and stopping of the sheet-turning device requires the following method steps:

In a first step, the transport drums must be brought into a defined changeover position, which is referred to hereinafter as the zero position. Bringing the drums into the zero position is accomplished manually or via the drive of the printing press or via additional actuating drives. Attainment of the zero position is checked or controlled visually with reference to marks or scales or is detected by means of sensors which send an appropriate zero-position signal. Published German Patent Document 38 36 310 A1, for example, describes an arrangement for controlling switching operations on a printing press wherein an incremental-angle sensor is coupled with a gear transmission which drives the transport drums, the angle sensor transmitting, per revolution, a defined number of angle pulses as well as a single zero pulse having a leading side or flank which is used as the zero-position signal.

In a further step, the relative phase positions of the printing units are reset in that a part which is not to be rotated in the drive system of the printing press is held fast, and the remaining part of the drive system is rotated through a defined angle relative thereto. An extremely wide range of different restraining and locking mechanisms, respectively, are used as the means for holding the non-rotating part of the drive system fast. The main drive of the printing press or an additional actuating drive may be employed as the actuating drive.

In a next step, the gripper-opening timings of the sheet-accepting and sheet-surrendering transport drums are reset in that, initially, the hold-fast or position-locking means of the gripper-control elements and of the gripper cam are released and, by means of separate drive elements, the gripper-control elements of the turning drum are displaced and the gripper cam of the storage drum is rotated.

In a further step, if required, the devices holding the trailing edges of the sheets may be set or adjusted, in accordance with the sheet size or format, to the trailing end of the respective sheet, on a transport drum serving as the storage drum, in that the held-fast or position-locking condition between these devices is released and in that the devices are reset, relative to the grippers holding the leading edge of the sheet, by a defined angle about a common shaft. All of the operating elements for effecting the position-locking or fast-holding conditions and all of the drive elements for the elements to be reset and all of the sensor elements for detecting the positions of the elements to be reset are connected to a control devices for controlling precise positioning.

For reasons of remote operation and automation, German Utility or Petty Patent (DE-GM) 83 19 431.2 and published German Patent Document 31 36 349 A1 describe constructions wherein the release and start-up of position-locking or fast-holding means, as well as the drive for resetting the elements are effected by hydraulic devices. A disadvantage of this construction is that hydraulic fluid is required to be brought through rotating bushings or pass-throughs to the corresponding working cylinders, which rotate together with the transport drums. One or more separate pressure lines are provided for each switching and clamping operation, respectively, so that elaborate multiple rotating bushings are required. The switching, clamping and actuating or adjusting operations, respectively, may be performed from a central location, the control operations being performed successively in a defined sequence by means of a distributor-type switching device. Consequently, these constructions do not operate in an optimized timed manner.

It is accordingly an object of the invention, to provide a method and device for starting and stopping a sheet-turning operation, which include simple stationary printing control elements, and reduce or shorten changeover times.

The object is achieved by effecting the adjustment of the phase position of the printing unit, of the gripper-opening instant of time and of the elements holding the leading and trailing edges of the sheet substantially simultaneously with one another, while the method steps specified in claim 1 are performed.

The device according to the invention includes a clutch actuated by pressure medium and disposed between means for adjusting the gripper control elements of a storage drum and drive means for adjusting the phase position of the printing unit relative to one another, the actuating elements of the clutch being connected to a control member of for pressure medium-activated adjustment members of a control device. Furthermore, another clutch actuated by pressure medium is provided which is disposed between separate drive means for adjusting the elements of the storage drum holding the sheet edges, and the adjustable elements holding the sheet edge.

The working cylinder of the pressure medium-actuated adjustment members are arranged, in accordance with the invention, so as to be fixed against rotation relative to the frame of the printing press, so that the device requires no expensive and untrustworthy rotary pass-throughs for feeding the pressure medium.

With the invention according to the instant application, the changeover time for mutually changing-over the operation of the press between one-sided printing, on the one hand, and first form and perfector printing, on the other hand, is able to be shortened, because all of the adjustment operations required therefor are performed substantially simultaneously. This involves both the jointly actuatable clampings and brakings, as well as the coupling oft the elements to be adjusted with drive elements. The adjustment of the elements of the storage drum holding the leading and trailing edges of the sheet to the corresponding sheet format or size can be performed in the first form and perfector printing operation or also in the on-sided printing operation.

An economic advantage derives from producing the clutches of the same type of construction, preferably, as friction clutches.

The clutch between the separate drive means for adjusting the elements holding the sheet edges, and the elements themselves may be formed of a first clutch-half constructed as a friction disc, which is firmly connected coaxially with a shaft rotatably supported or journaled in the press frame, and to which a servomotor is coupled as a separate drive means, the first half-clutch being connected to a piston of a pressure-medium cylinder for axially displacing the first half-clutch in a direction towards a second clutch-half. The second clutch-half is then connected to a gear transmission for adjusting the aforementioned elements.

The clutch between the means for adjusting the gripper control elements of the storage drum and the drive means for adjusting the phase position of the printing units relative to one another may be formed of a first clutch-half constructed as a friction disc, which is firmly connected coaxially with a shaft, which is rotatably supported or journaled in a side wall of the printing press and has a gear for adjusting the aforementioned gripper control elements fastened thereon, the first clutch-half being coupled with the piston of a further pressure-medium cylinder for axial displacement in a direction towards a second clutch-half. The second clutch-half is then coupled with a gear transmission for driving the printing press.

The invention should be explained in greater detail with respect to an exemplary embodiment. As presented in the drawing:

FIG. 3 is a clutch between a part of the drive system and adjusting elements for gripper control elements of a storage drum in at-rest position;

Figure 1:
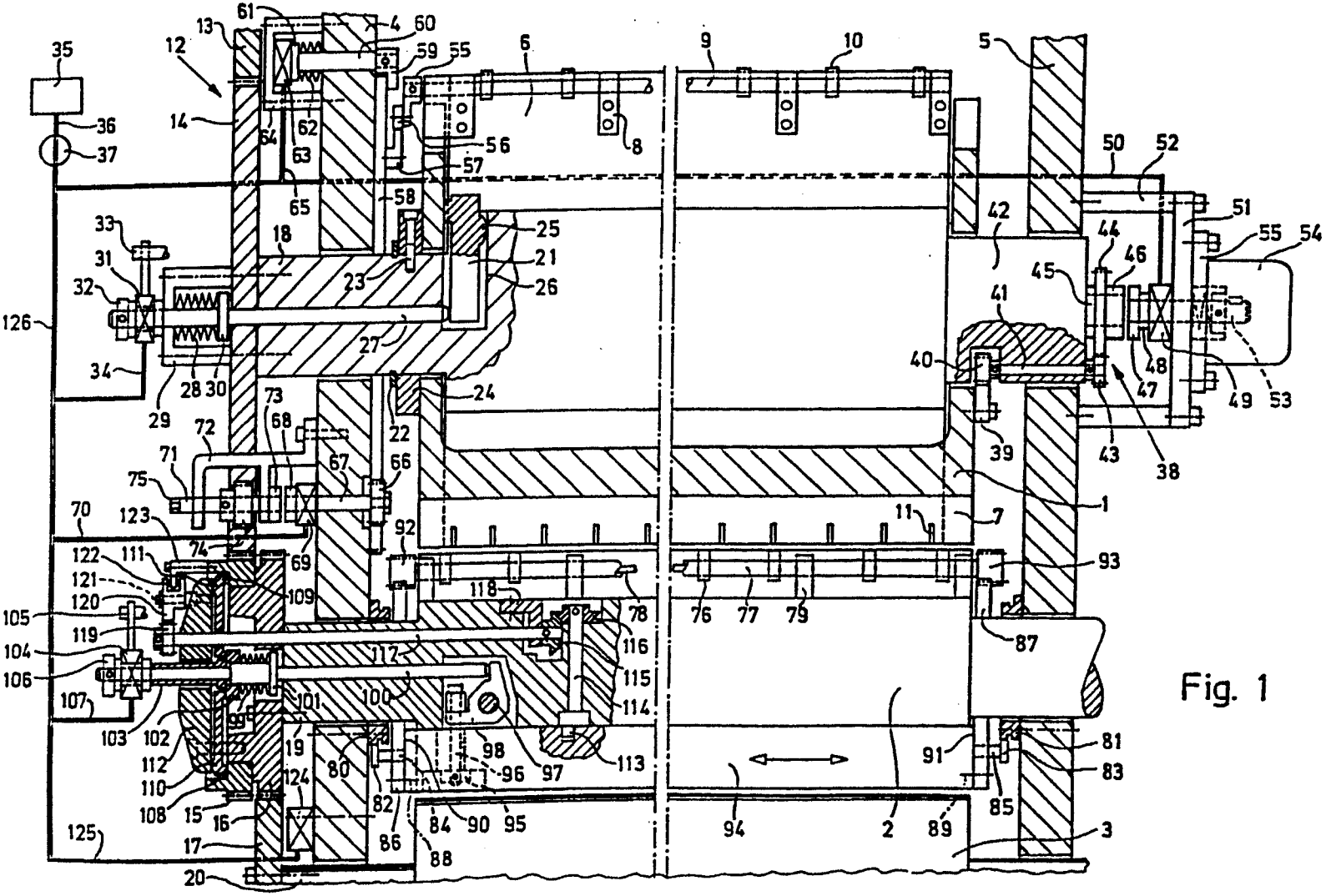
FIG. 1 is a schematic view of a device for starting and shutting down the sheet turning operation.

The schematic view presented in FIG. 1 of a device with which the method according to the invention may be performed shows a storage drum 1, a turning drum 2 and an impression cylinder 3, which are journaled in side walls 4 and 5 of a printing press. The storage drum 1 is formed of two sheet support segments 6 and 7. Bearings 8 for a gripper shaft or bar 9, whereon grippers 10 for sheet leading edges are arranged, are secured to the sheet support segment 6. The sheet support segment 7 is arranged so as to be rotatable relative to the sheet support segment 6 about a common rotary axis, and carries a suction device 11 for the trailing edge of the respective sheet.

The impression cylinder 3, the turning drum 2 and the storage drum 1, which has a diameter double that of the other drum and cylinder, are mutually driven by a gear transmission 12. In the gear train of the transmission 12, there are a gear 13 assigned to the preceding transport drum, a gear 14 assigned to the storage drum 1, a ring gear 15 and a gear 16 assigned to the turning drum 2, and a gear 17 assigned to the impression cylinder 3. The gears 14, 16 and 17 are firmly seated, respectively, on the shaft ends 18, 19 and 20, of the storage drum 1, the turning drum 2 and the impression cylinder 3, respectively, which are journaled in the side wall 4.

The sheet support segments 6, 7 are secured to one another against relative rotation by means of a releasable frictional restraint. In clamped condition, a short arm of a clamping lever 21 presses the movable sheet support segment 7 against a counter-bearing 24 fastened by a shaft retaining ring 22 and screws 23 on the shaft end 18. The clamping lever 21 is formed with a support element 25 by which it rests on a flat surface 26 machined in the sheet support segment 6. A coaxially disposed pressure rod 27 directed towards a long arm of the clamping lever 21 and braced by means of a spring 28 between a bridge 29 mounted on the gear 14 and a pressure-rod flange 30 exerts a force action on the long arm of the clamping lever 21. The clamping of the sheet support segments 6 and 7 is releasable by means of an hydraulic working cylinder in that, with pressure application, the piston of the working cylinder 31 presses against a stop ring 32, so that the spring 28 is subjected even to more tension and the action of force on the long arm of the clamping lever 21 is reduced or cancelled. The working cylinder 31 is fixed to the side wall 4 by a device 33 for protecting against torsion. The working cylinder 31 is connected via a line 34 to a pressure-medium supply 35 having a departure line 36 in which a pressure monitor 37 is connected.

The relative adjustment of the sheet support segments 6, 7 to one another is effected via a gear transmission 38. In this regard, the movable sheet support segment 7 is provided, at the end face thereof facing towards the side wall 5, with a toothed segment 39 meshing with a pinion 40 which is fastened on a shaft 41 mounted in a bore formed in an end shaft 42 and extending parallel to the rotational axis of the storage drum 1. At the outside, another pinion 43 is seated which meshes with a gear 44 arranged coaxially with the storage drum 1 and rotatably mounted on an extension 45 of the shaft end 42. An end face of the gear 44 is formed as a clutch disc 46. Another clutch disc 47 connected to a shaft 53. The working cylinder 49 is connected by a line 50 to the pressure-medium supply 35. When subjected to pressure, the piston 48 can move with the clutch disc 47 axially in the direction of the clutch disc 46. The working cylinder 49 is mounted on a plate 51 which is anchored by bolts to the side wall 5. The clutch disc 47 is rotatably mounted together with the shaft 53, which extends through the working cylinder 49 and the plate 51. The shaft 53 is coupled with the rotor of a servomotor 54 having a motor flange 55 which is fastened to the plate 51. The servomotor 54 is connected, as is also the pressure-medium supply 35, to a non-illustrated control device of the printing press.

On the end of the gripper shaft 9, a roller lever 55 for gripper control is fastened. A cam roller 56 is seated at an end of the roller lever 55 and runs on a cam 57. The cam 57 which is arranged on a toothed segment 58 can be adjusted with the latter. For this purpose, a friction brake must be released which is formed of a clamping member 59 which presses the gear segment 58 against the side wall 4, the clamping member 59 being fastened on an axially displaceable bolt 60 guided in the side wall 4 and having an end facing away from the toothed segment 58 and carrying a flange 61, between which and the side wall 4, a spring 62 is disposed under stress. In axial direction, the flange 61 is pressed by the spring 62 in a direction towards another hydraulic working cylinder 63, which is braced against a bridge 64 mounted on the side wall 4. The working cylinder 63 is connected by a line 65 to the pressure-medium supply 35. The adjustment of the cam 57 is effected with a pinion 66 which meshes with the toothed segment 58. The pinion 66 is firmly seated on a shaft 67 which is mounted in the side wall 4. A clutch flange 68 is attached to the other end of the shaft 67 and, together with the pinion 66, is axially displaceable by means of a working cylinder 69. The working cylinder 69 is connected via a line 70 to the pressure-medium supply 35. A shaft 71 which is mounted in a bifurcated bearing block 72 fastened to the side wall 4 is disposed coaxially with the shaft 67. Another clutch flange 73 which is associated with the clutch flange 68 is attached to one end of the shaft 71. An adjusting gear 74 which is in continuous meshing engagement with the gear 14 is fastened to the shaft 71. The adjustment of the cam 57 can thus be effected via the gear transmission 12. Manual adjustment means which permit turning of the press, for example, in an emergency, are couplable with the free shaft end 75. Tongs grippers 76 are disposed on the turning drum 2, a respective jaw of each of the tongs grippers 76 being fastened to a respective gripper shaft 77, 78, each of which is guided coaxially in bearings 79. Control of the tongs grippers 76 is effected by two double cams 80 and 81 fastened to the side walls 4 and 5 and having cam rollers 82 and 83 rolling thereon. The cam rollers 82 and 83 are fastened on pins 84 and 85 which are disposed on gripper control segments 86 and 87. The gripper control segments 86 and 87 are mounted so as to be rotatable about swivel axes 88 and 89 on the end faces 90 and 91 of the sliding carriage 94. The axes of the pins 84 and 85 are spaced a defined distance from one another. As the cam rollers 82, 83 roll on the double cams 80, 81, the gripper control segments 86, 87 perform a cyclical swiveling movement. The gripper control elements 86, 87 are formed over the swivel range thereof with toothing which is in meshing engagement with pinions 92, 93 which are seated at the ends of the gripper shafts 77, 78 laterally of the turning drum 2.

To convert the turning drum 2 from printing on only one side of a sheet, i.e., recto printing, to first-form and perfector printing, i.e., recto/verso printing, the cam rollers 82, 83 must be shifted in axial direction onto the second cams of the double cams 80, 81. For this purpose, part of the turning drum 2 is constructed as the slide carriage 94. During the printing operation, the slide carriage 94 is pressed against the remaining part of the turning drum 2 by a clamping head 95. The clamping head 95 is connected to a radially aligned tie rod 96 which, through the intermediary of a bellcrank 98 mounted on a pin 97 and a plunger 100 biased by a spring 99, presses the slide carriage 94 against the remaining part of the turning drum 2. The spring 99 is braced at one end thereof against a flange 101 of the plunger 100, and at the other end thereof against a thrust ring 102, against which a sleeve 103 axially displaceable on the plunger 100 and an hydraulic working cylinder 104 lie.

The working cylinder 104 is fixed to the side wall 4 by a device 105 protecting against torsion, is braced by a side thereof facing away from the sleeve 103 against a stop ring 106 fastened to the end of the plunger 100, and is connected via a line 107 likewise to the pressure-medium supply 35.

When the working cylinder 104 is subjected to pressure, the sleeve 103 is displaced against a stop on the plunger 100. This displacement is transmitted to the pressure ring 102, so that the spring 99 is compressed. Accordingly, the action of the spring 99 as a force-generating element in the clamping of the slide carriage 94 against the turning drum 2 and in the clamping of the ring gear 15 against the gear 16 is nullified. In one direction of action of the spring 99, the force on the bellcrank 98 is nullified, so that the clamping head 95 releases the slide carriage 94. In the other direction of action of the spring 99, the action of the force on the longer arms of the double-armed clamping levers 108 and 109 concentrically arranged in radial direction is nullified. The clamping levers 108, 109 lean with bracing elements 110 and 111 against a planar surface of a bracing plate 112, the shorter arms of the clamping levers 108, 109 acting against the end face of the ring gear 15. The other end face of the ring gear 15 which is rotatably mounted on an extension of the gear 16 lies against a planar surface formed on the gear 16 and, during the printing operation, as a protection against torsion, is pressed with the aid of the clamping levers 108, 109 against the planar surface on the gear 16. The bracing plate 112 is firmly connected to the gear 16. If the force action of the spring 99 is removed from the clamping levers 108 and 109, the protection against torsion between the ring gear 15 and the gear 16 is nullified.

For axially adjusting the slide carriage 94, the latter is coupled with an eccentric entrainer pin 113 of an eccentric bolt 114 which is disposed in radial direction to and rotatably mounted in the turning cylinder 2. A bevel gear 116 is fastened to an end of the eccentric bolt 114 and cooperates with another bevel gear 115. The bevel gear 115 is seated at the end of a control shaft 117 which is mounted in a bearing 118 so as to be rotatable about an axis which is disposed parallel to the rotational axis of the turning drum 2. Within the shaft end 19 of the turning drum 2, the control shaft 117 is guided through the gear 16 and the bracing plate 112 to the outside, a pinion 119 being fastened to the end of the control shaft 117. The pinion 119 is in meshing engagement with a toothed segment 120 which is swivellable about a pin 121 fastened to the bracing plate 112. On the side of the toothed segment 120 facing away from the toothing thereof, a rotatably disposed entrainer pin 122 extends in axial direction and is spaced from the axis of the pin 121. A fork of a control member 123 which is fastened to the ring gear 15 is disposed over the entrainer pin 122. When the ring gear 15 and the gearwheel 16 are turned with respect to one another about the rotational axis of the turning drum 2, the slide carriage 94 is displaced via the control member 123 with the entrainer pin 122, the toothed segment 120, the pinion 119, the control shaft 117, the bevel gears 115 and 116 and the eccentric bolt 114, so that the cam rollers 82, 83 and the gripper control segments 86, 87 cooperate with the second cams of the double cams 80, 81.

In order that, during the turning of the ring gear 15 and the gearwheel 16 relative to one another, the gearwheel 16 and the following gearwheels 17 are held fast, another working cylinder 124 is fastened to the side wall 4 opposite the end face of the gearwheel 17 and is provided with a piston which engages with the end face when the cylinder is subjected to pressure via the line 125.

All of the lines 34, 50, 65, 70, 107 and 125 connected to a main line 126.

Figure 2:
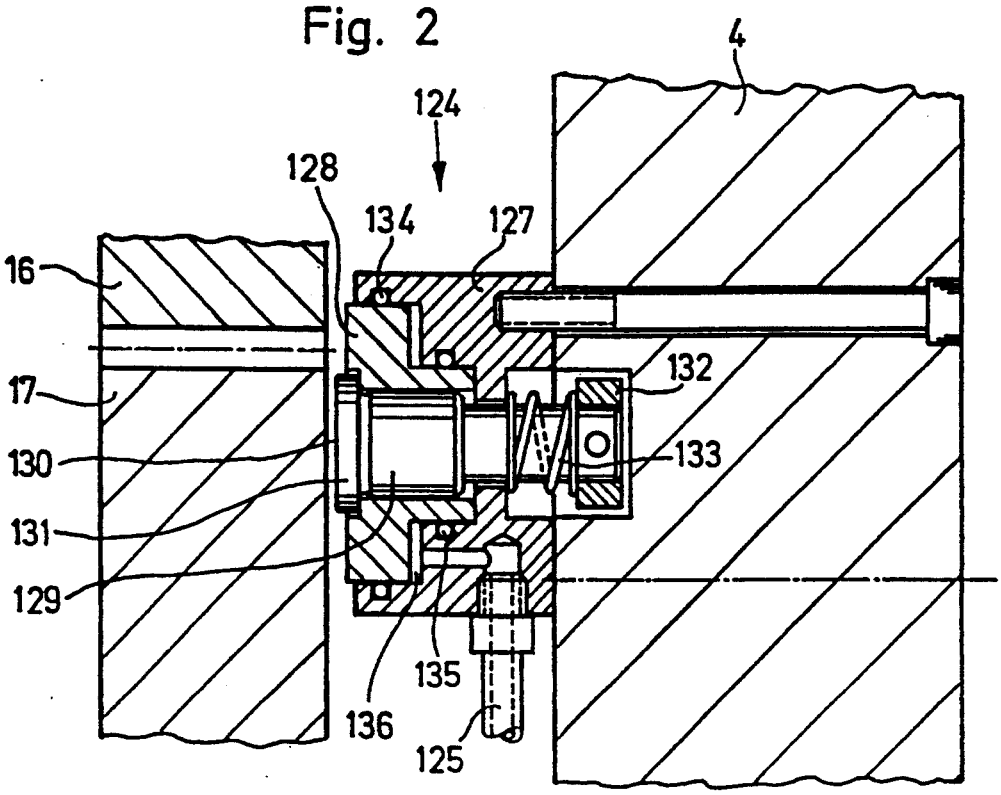
FIG. 2 is a clamping device for a part of a drive system in an at-rest position.
Figure 3:
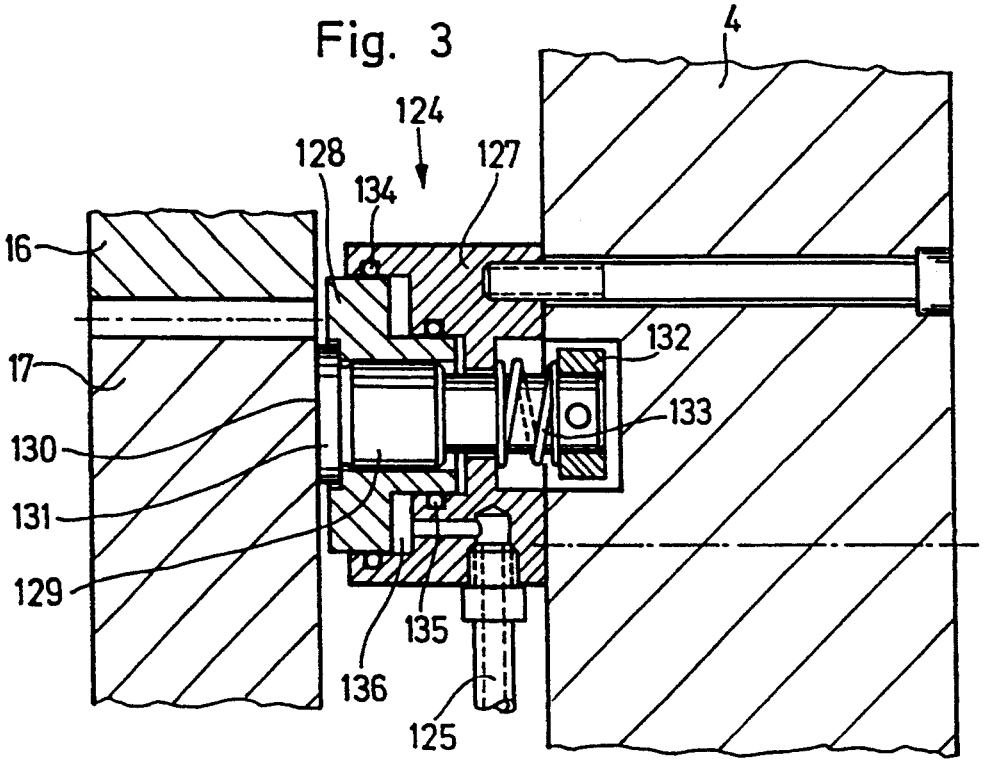
FIG. 3 is the clamping device according to FIG. 2 in working position.

In FIGS. 2 and 3, the at-rest and working positions of the working cylinder 124 is represented in detail. The working cylinder 124 is formed of a housing 127 wherein a piston 128 is axially displaceably disposed. A thrust bolt 129 is centrally arranged in the piston 128 and is formed with a bearing surface 130 disposed parallel to the end face of the gearwheel 17. The thrust bolt 129 has a head 131 with which it engages a planar surface of the piston 128. The thrust bolt 129 extends through the housing 127, and a restoring spring 133 is installed between the outer wall of the housing 127 and a stop ring 132 at the end of the thrust bolt 129. Sealing rings 134, 135 seal the pressure chamber 136 against the atmosphere.

Figure 4:
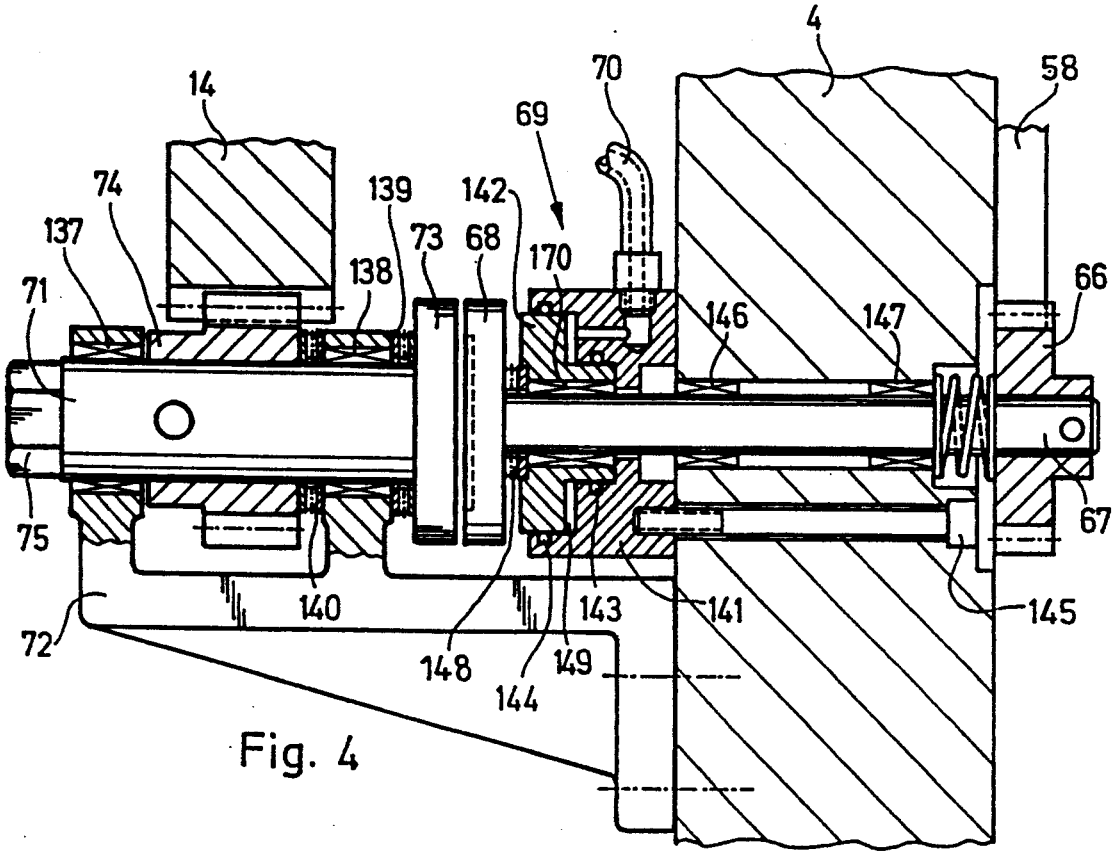
Figure 5:
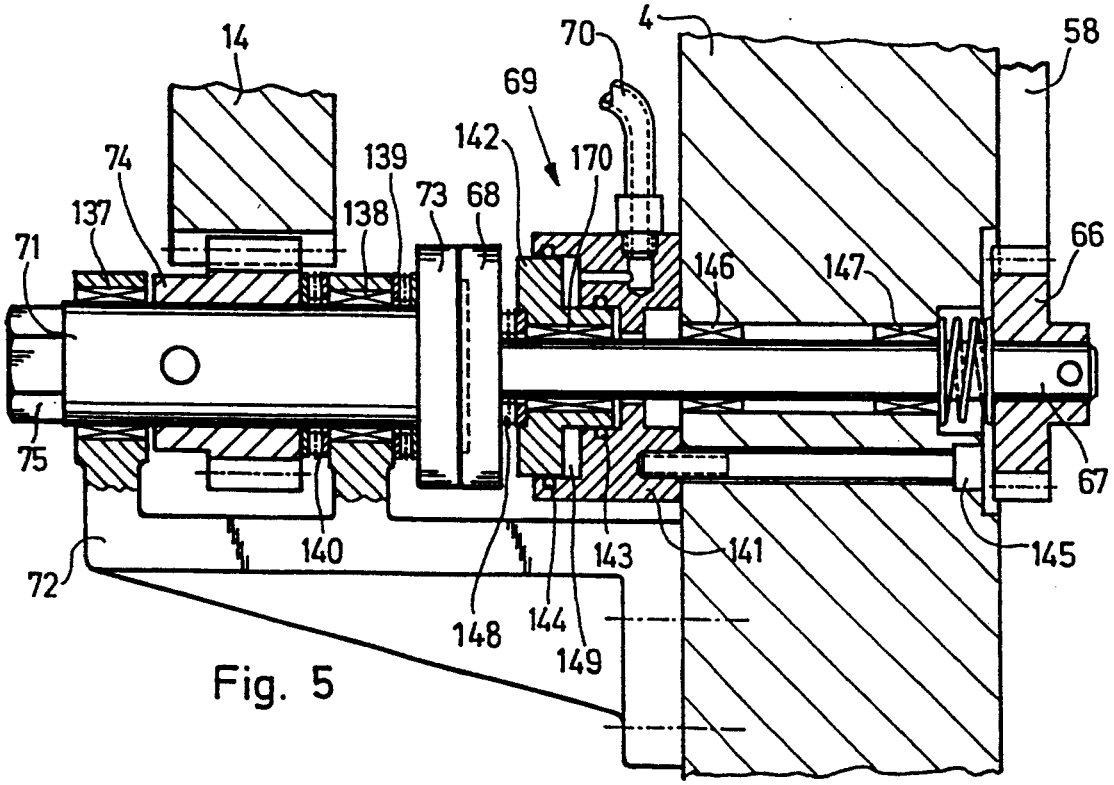
FIG. 5 is the clutch according to FIG. 4 in working position.

FIGS. 4 and 5 show the action of the working cylinder 69 when the clutch flanges 68 and 73 are engaged. The shaft 71 is journalled in radial bearings 137, 138 and axial bearings 139, 140, so that the clutch flange 73 can rotate freely. The working cylinder 69 is formed of a housing 141 with a piston 142 and sealing rings 143, 144. The housing 141 is fastened to the side wall 4 by bolts or screws 145. The shaft 67 extends through the piston 142 and the housing 141 and is rotatably and axially displaceably arranged in radial bearings 146, 147. An axial bearing 148 between the clutch flange 68 and the piston 142 as well as a radial bearing 170 in the piston 142 prevent co-rotation of the piston 142. After a pressure chamber 149 has been subjected to pressure, the clutch flange 68 is displaced into the position illustrated in FIG. 5, so that due to the clutching engagement starting from the gearwheel 14, an adjustment of the toothed segment 58 can result.

Figure 6:
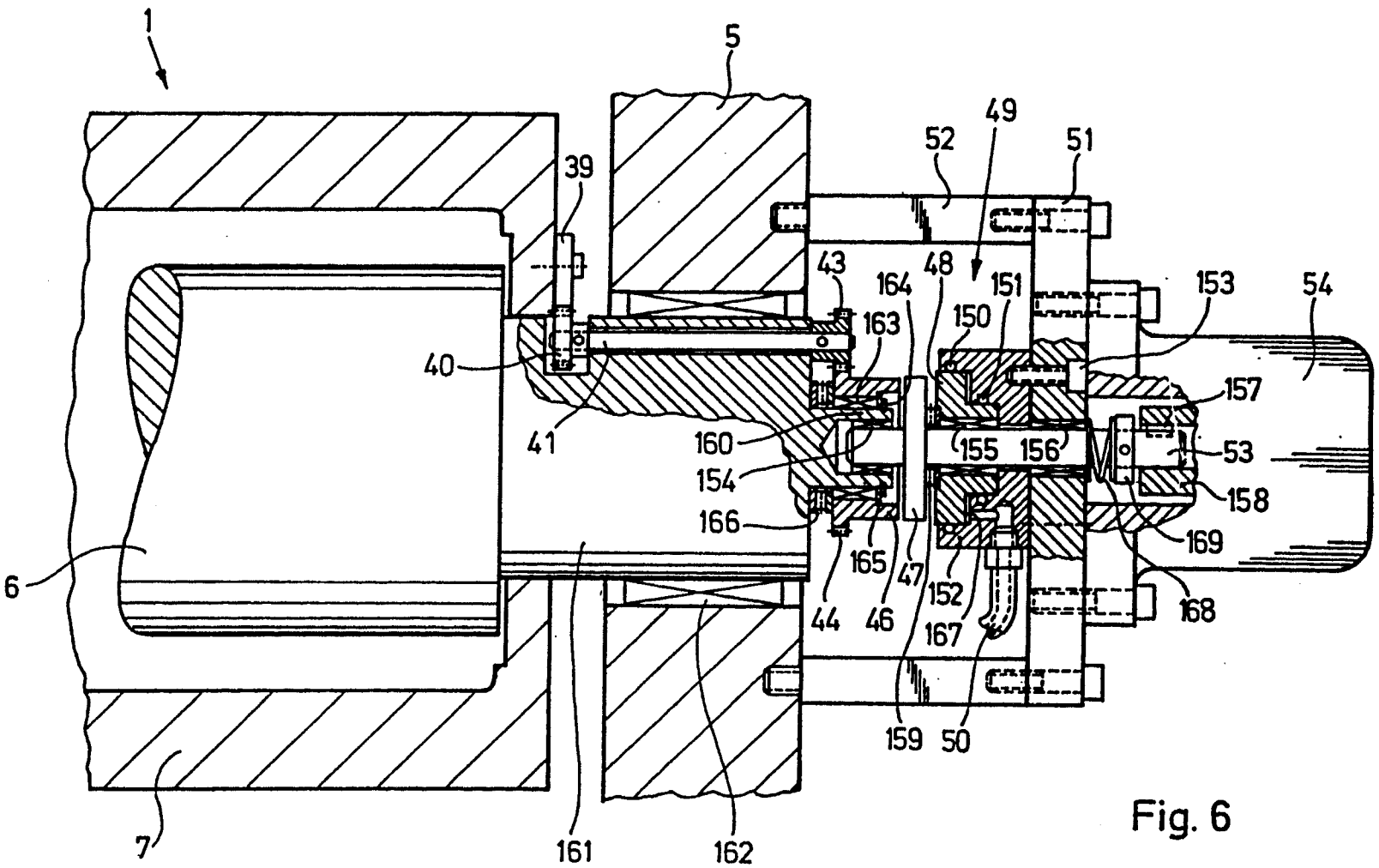
FIG. 6 is a clutch between a separate drive device and means for adjusting sheet support elements of a storage drum.

In FIG. 6, the operation of the clutch between the clutch discs 46 and 47 with the aid of the working cylinder is shown in greater detail. The piston 48 is seated in a housing 152 provided with sealing rings 150, 151 and fastened by bolts or screws 153 to the plate 51. The shaft 53 to which the clutch disc 47 is attached is rotatably and axially displaceably arranged in radial bearings 154, 155 and 156. On the one side, the shaft 53 passes through the piston 48, the housing 152 and the plate 51, the end of the shaft 53 being coupled by means of a key 157 with the rotor 158 of the servomotor 54. Between the clutch disc 47 and the piston 48, an axial bearing 159 is provided. The other side of the shaft 53 extends into the bore of the radial bearing 154, which is disposed in a journal 160 of a shaft end 161 of the storage drum 1. The shaft end 161 is supported in radial bearings 162 in the side wall 5. The gearwheel 44 is supported by radial bearings 163 on the journal 160, the gearwheel 44 being safeguarded against axial displacement by a retaining ring 164 and a washer 165 and being turnable against a planar surface of the shaft end 161 with an axial bearing 166. When the pressure chamber 167 is subjected to pressure, the clutch disc 47 moves with the piston 48 in the direction of the planar surface of the gearwheel 44 which acts as the clutch disc 46. Starting from the rotor 158 of the servomotor 54, an adjusting movement of the sheet-supporting segments 6 and 7 to one another can then be introduced. An adjusting spring 168, which is braced on the one side against the plate 51 and on the other side against a stop ring 169 fastened to the shaft 53, causes a resetting of the clutch disc 47 when the pressure is removed from the line 50.

With the aforedescribed device, the method for starting and stopping the sheet-turning operation is performed as follows:

In a first step, controlled by the control device, all of the working cylinders 31, 49, 63, 69, 104 and 124 are subjected to pressure via the pressure-medium supply 35. The effect thereof is that the part not to be rotated in the drive system of the printing press to which the gearwheels 16 and 17 belong are held fast with the aid of the working cylinder 124. Furthermore, with the aid of the drive cylinder 104, the holding fast of the part to be rotated in the drive system, to which the gears 13 and 14 and the ring gear 15 belong, to the aforementioned part not to be rotated, as well as the holding fast of the slide carriage 94, are nullified. The subjection to pressure of the working cylinder 31 has the effect that the clamping together of the sheet-supporting segments 6 and 7 of the storage drum 1, respectively, holding the leading edge of the sheet and the trailing edge of the sheet, is nullified. By means of the working cylinder 63, the holding fast of the toothed segment 58 and the cam 57, respectively, is nullified.

Simultaneously with the nullification of the various holding-fast conditions, adjusting elements for the cam 57 are clutchingly engaged or coupled with the aforementioned part to be rotated in the drive system, by means of the working cylinder 69. Furthermore, the working cylinder 49 effects a coupling or clutching engagement of adjusting elements for the sheet-supporting segments 7 relative to the sheet-supporting elements 6 with a separate adjusting drive encompassing the motor 54.

In a second step, the part to be rotated in the drive system can be rotated, controlled by the control device, about a defined angle, this part being positioned by the main drive of the printing press. By rotating the gearwheels 13, 14 and the ring gear 15, the toothed segment 58 is adjusted with the cam 57 via the adjusting gear 74, the shaft 71, the clutch flanges 68 and 73, the shaft 67 and the pinion 66. Simultaneously, the slide carriage 94 is axially displaced via the control member 123, the entrainer pin 122, the toothed segment 120, the pinion 119, the control shaft 117, the bevel gears 115 and 116, the eccentric bolt 114 and the entrainer pin 113, so that the cam rollers 82, 83 are displaced onto the respective other cam of the double cams 80, 81. Because the gears 16 and 17 of the drive system are held fast by means of the working cylinder 124, the phase position of the ring gear 15 with respect to the gear 16 is also simultaneously altered. Furthermore, the control device can activate the servomotor 54 to adjust the sheet-supporting segment 7 about an angle dependent upon the sheet format.

In a final step, pressure can be withdrawn from the working cylinders 31, 49, 63, 69, and 104, by means of the control device, so that all of the clutches and the fast-holding conditions are returned to the starting conditions thereof.

The device may be modified by, for example, connecting valves, which are controllable by the control device, in the individual pressure lines 50, 65, 34, 70, 107 and 125. Thus, for example, the possibility exists, if it is necessary during perfector or verso printing, of adjusting the sheet-supporting segments 6, 7 separately from one another to the sheet format to be processed, for the purpose of applying suction to the trailing edge of the sheet in order to improve sheet guidance, while all the other aforementioned adjustments do not have to be taken into consideration.

I claim:

1. Method of starting and stopping a sheet-turning operation during sheet transport through a recto-and-verso printing press, which comprises singly conveying the sheets in succession, by at least one transport drum, between two printing units; at a changeover of the printing press from recto-printing mode to recto-and-verso printing mode and back again and for sheet-format adjusting, starting from a changeover position, adjusting phase positions of printing units of the press with respect to one another, locking in position a part of a drive system of the printing press which is not to be rotated, and rotating a remaining part of the drive system through a defined angle relative to the part locked in position, adjusting gripper-opening timings of sheet-accepting and sheet-surrendering transport drums in the printing press so that, in the recto-printing mode, sheets are surrendered and accepted by a leading edge thereof and, in recto-and-verso-printing mode, the sheets are accepted by a trailing edge thereof and, when required for sheet-format adjusting, on a transport drum serving as a storage drum and having devices for holding the trailing edge of the sheets, adjusting the holding devices at the trailing end of the respective sheet in accordance with the sheet format by displacing the holding devices through a defined angle about a common shaft in relation to grippers holding the leading edge of the sheet; by means of a control device connected to actuating elements for transport-drum elements, which are to be moved in starting and stopping the sheet-turning operation and in sheet-format adjusting, and to sensor elements for detecting the positions of the transport-drum elements, positioning and locating the transport-drum elements; performing the adjustment of the phase position of the printing units, gripper-opening elements holding the sheet leading edge and the sheet trailing edge with respect to one another substantially simultaneously; by means of a pressure medium system actuated by the control device, simultaneously locking the not-to-be rotated part in the drive system, nullifying locking means between the remaining part to be rotated and the not-to-be rotated part in the drive system, between sheet leading-edge holding elements and sheet trailing-edge holding elements of the storage drum, as well as locking means of the gripper control elements of one of turning drums down-line from the storage drum and gripper control elements of the storage drum; thereafter, by means of the pressure-medium system actuated by the control device, simultaneously coupling adjusting elements of a gripper opening cam of the storage arum with a first adjusting drive for adjusting the remaining part to be rotated in the drive system; coupling with a second adjusting drive adjusting elements of the elements holding the sheet edges; thereafter, by means of the first and second adjusting drives actuated by the control device, performing the foregoing adjustments and, thereafter, by means of the pressure-medium system actuated by the control device, returning all couplings and the locking means to a starting position thereof.

2. Device for starting and stopping a sheet-turning operation during sheet transport through a printing press, including a storage drum and a turning drum, respectively, having gripper-control elements, a gripper cam for the storage drum, drive means for adjusting relative phase positions of printing units of the printing press disposed up-line and down-line from the turning drum, the drive means including a part to be rotated and a part not to be rotated, locking means for locking in position the part of the drive means which is not to be rotated, means for adjusting the gripper-control elements of the storage drum and of the turning drum, position-locking means for fixing the turning-drum gripper-control elements and further position-locking means for fixing the storage-drum gripper cam, the turning-drum gripper-control elements being axially displaceable and the storage-drum gripper cam being rotatable about the axis of the storage drum, separate drive means for adjusting, relative to one another about the axis of the storage drum, two groups of elements of the storage drum for holding a leading edge and a trailing edge, respectively, of sheets being transported, pressure-medium actuated locking means for locking said sheet-edge holding elements in position relative to one another, and a control device connected to the adjusting means and to sensor elements for detecting the positions of the adjustable elements relative to respective non-adjustable elements, the control device containing a control part for pressure-medium actuated control elements, the device for starting and stopping the. Sheet-turning operation comprising a pressure-medium actuated clutch connected to the control part of the control device, between the means for adjusting the gripper control elements of the storage drum and the drive means for adjusting the phase position of the printing units to one another, and a pressure-medium actuated clutch connected to the control part of the control device, between the separate drive means for adjusting the elements of the storage drum holding the sheet edge and the adjustable elements holding the sheet edge, and the pressure-medium actuated control elements, respectively, including a working cylinder arranged so as to be fixed against torsion with respect to a frame of the printing press.

3. Device according to claim 2, wherein said clutches are of like construction type.

4. Device according to claim 2, wherein said clutch between the separate drive means for adjusting the elements holding the sheet edges, and the control elements themselves are formed of two clutch halves, one of said clutch halves being formed as a friction disc firmly connected coaxially with a shaft rotatably mounted in the press frame and having a servomotor as a separate drive motor coupled therewith, said one clutch half being coupled with a piston of a pressure-medium cylinder so as to be axially displaceable thereby in a direction of the other of said clutch halves, said other clutch half being coupled with a gear transmission for adjusting said elements holding the sheet edges.

5. Device according to claim 2, wherein said clutch between the means for adjusting the gripper control elements of the storage drum and the drive means for adjusting the phase position of the printing units with respect to one another is formed of two clutch halves, one of said clutch halves being constructed as a friction clutch and being rigidly connected coaxially with a shaft rotatably and axially displaceably mounted in a side wall of the printing press and having a gearwheel for adjusting said gripper control elements of the storage drum fastened thereon, said one clutch half being coupled with a piston of a pressure-medium cylinder so as to be axially displaceable thereby in a direction towards the other of said two clutch halves, and said other clutch half being coupled with a gear transmission for driving the printing press.

6. Device according to claim 3, wherein said clutches are friction clutches.

* * * * *